US008397351B2

(12) United States Patent
Lara et al.

(10) Patent No.: US 8,397,351 B2
(45) Date of Patent: Mar. 19, 2013

(54) SLIDE FOR LIFE-LINE

(75) Inventors: Pascal Lara, Nice (FR); Christian Hamann, Nice (FR)

(73) Assignee: Capital Safety Group Emea, Carros Cedox (FR)

( * ) Notice: Subject to any disclaimer, the term of this patent is extended or adjusted under 35 U.S.C. 154(b) by 930 days.

(21) Appl. No.: 11/918,661

(22) PCT Filed: Apr. 14, 2006

(86) PCT No.: PCT/EP2006/061616

§ 371 (c)(1),
(2), (4) Date: Oct. 17, 2007

(87) PCT Pub. No.: WO2006/111513

PCT Pub. Date: Oct. 26, 2006

(65) Prior Publication Data

US 2009/0056083 A1 Mar. 5, 2009

(30) Foreign Application Priority Data

Apr. 22, 2005 (FR) ..... 05 51043

(51) Int. Cl.
*A62B 35/00* (2006.01)

(52) U.S. Cl. ..... 24/134 R; 24/115 R; 182/36; 182/191; 104/115

(58) Field of Classification Search ..... 24/115 R, 24/132 R, 134 L, 133, 134 R, 134 KA, 134 KB, 24/132 SA, 132 WL; 104/182, 115, 87, 235; 182/36, 5, 3, 191, 193; 248/237
See application file for complete search history.

(56) References Cited

U.S. PATENT DOCUMENTS

| | | | | | |
|---|---|---|---|---|---|
| 3,179,994 | A | * | 4/1965 | Meyer et al. | 24/134 R |
| 3,852,943 | A | * | 12/1974 | Healy | 24/134 R |
| 3,876,036 | A | * | 4/1975 | Sweet | 182/18 |
| 4,034,828 | A | * | 7/1977 | Rose et al. | 182/5 |
| 4,465,011 | A | * | 8/1984 | Merry | 114/199 |
| 4,560,029 | A | * | 12/1985 | Dalmaso | 182/5 |
| 4,584,945 | A | * | 4/1986 | Tupper | 104/182 |
| 4,846,075 | A | * | 7/1989 | Tupper | 104/209 |
| 5,156,240 | A | * | 10/1992 | Ostrobrod | 188/65.1 |
| 5,224,427 | A | * | 7/1993 | Riches et al. | 104/115 |
| 5,238,084 | A | * | 8/1993 | Swager | 182/8 |
| 5,265,696 | A | * | 11/1993 | Casebolt | 182/8 |
| 5,316,103 | A | * | 5/1994 | Bell et al. | 182/18 |
| 5,325,788 | A | | 7/1994 | Strickland et al. | |
| 5,343,975 | A | * | 9/1994 | Riches et al. | 182/3 |
| 5,350,037 | A | * | 9/1994 | Ghahremani | 182/3 |

(Continued)

FOREIGN PATENT DOCUMENTS

| | | |
|---|---|---|
| DE | 295 17 560 U1 | 1/1996 |
| GB | 2 389 386 A | 12/2003 |

(Continued)

*Primary Examiner* — Robert J Sandy
*Assistant Examiner* — Rowland D Do
(74) *Attorney, Agent, or Firm* — IPLM Group, P.A.

(57) ABSTRACT

A slide displaced along a life-line. The slide includes a body provided with a guide duct through which a cable passes. The slide further includes a handle that is capable of interacting with an attached connecting mechanism. The handle is articulated relative to the body such that the handle has a freedom of rotary movement of axis in a direction perpendicular to a longitudinal axis of the guide duct and different from a direction of traction of the connecting mechanism of the handle.

13 Claims, 6 Drawing Sheets

U.S. PATENT DOCUMENTS

| | | | | |
|---|---|---|---|---|
| 5,638,919 | A * | 6/1997 | Pejout | 182/192 |
| 5,855,251 | A * | 1/1999 | Deuer | 182/5 |
| 5,860,493 | A * | 1/1999 | Cherpitel | 188/65.2 |
| 5,924,522 | A * | 7/1999 | Ostrobrod | 182/191 |
| 6,263,999 | B1 | 7/2001 | Atkinson et al. | |
| 6,412,420 | B1 * | 7/2002 | Kramer et al. | 104/182 |
| 6,467,574 | B2 | 10/2002 | Lara | |
| 6,776,103 | B2 * | 8/2004 | Simard et al. | 104/112 |
| 7,080,716 | B2 * | 7/2006 | Cherpitel | 182/192 |
| 7,108,099 | B2 * | 9/2006 | Ador | 182/5 |
| 7,222,840 | B1 * | 5/2007 | Stepper | 254/391 |
| 2003/0006095 | A1 | 1/2003 | Desjardins | |
| 2004/0026932 | A1 * | 2/2004 | Coleman et al. | 292/241 |

FOREIGN PATENT DOCUMENTS

| | | | |
|---|---|---|---|
| GB | 2 420 820 | A | 6/2006 |
| WO | 02/092171 | A1 | 11/2002 |

* cited by examiner

FIG. 3
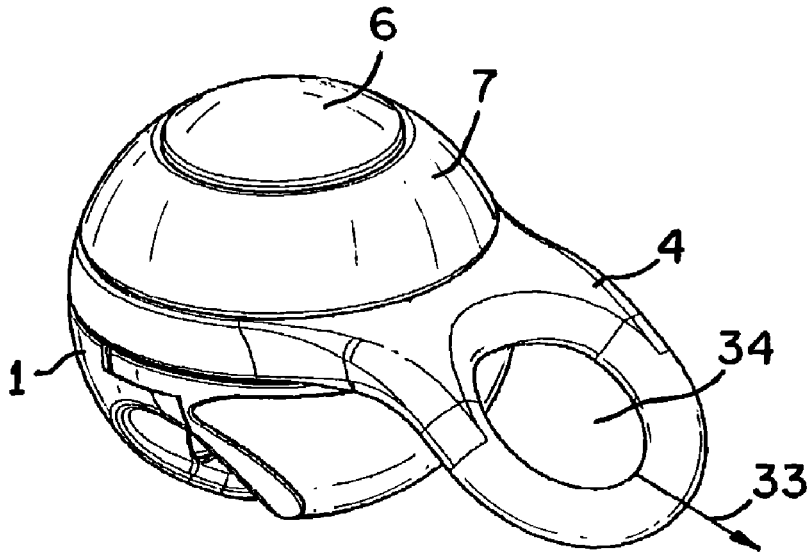
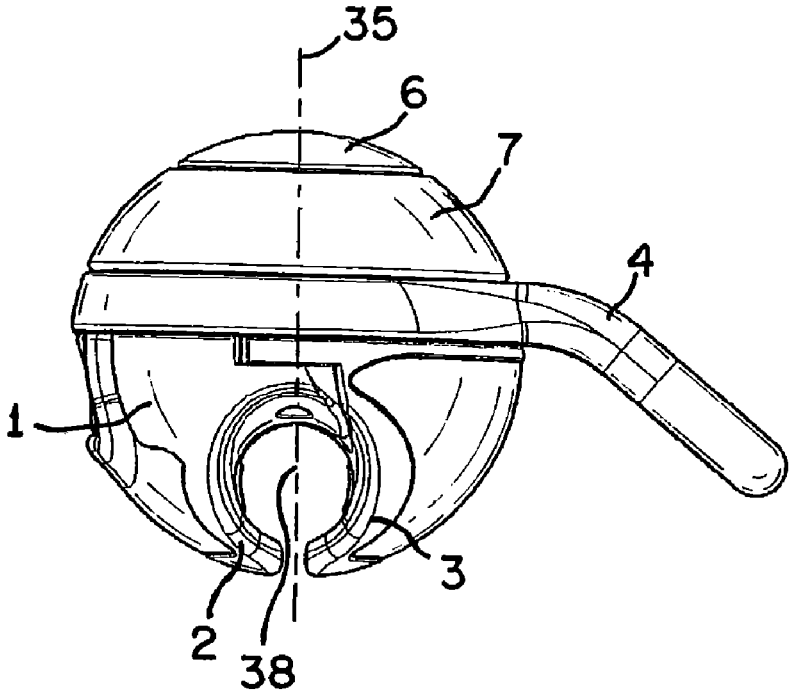
FIG. 4

FIG. 5
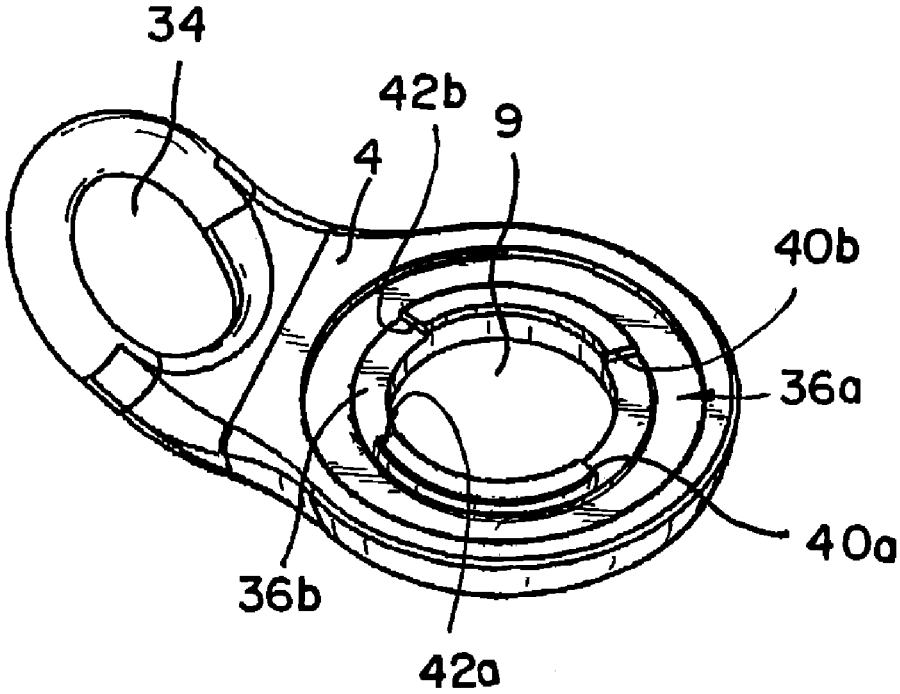
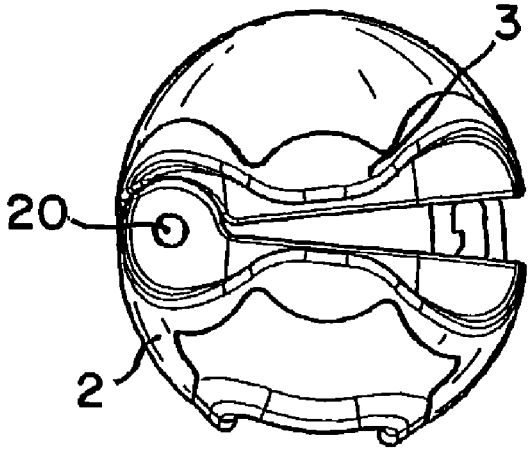
FIG. 6

FIG. 7
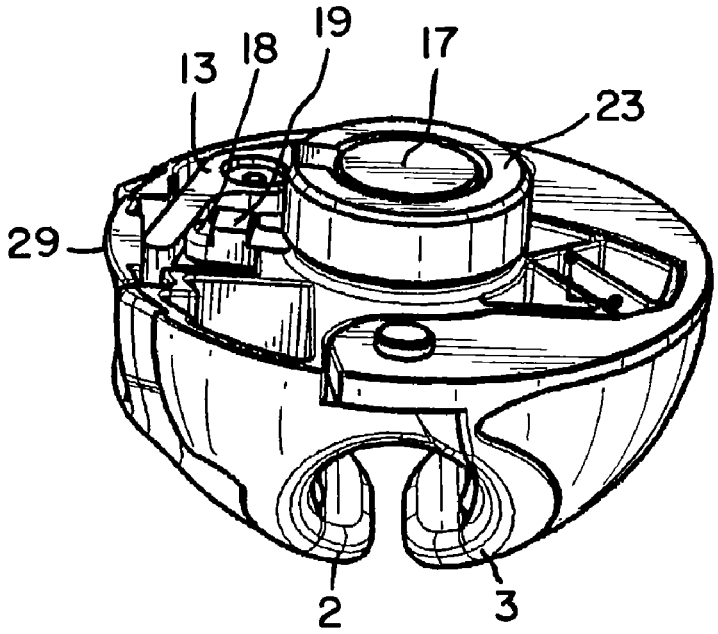
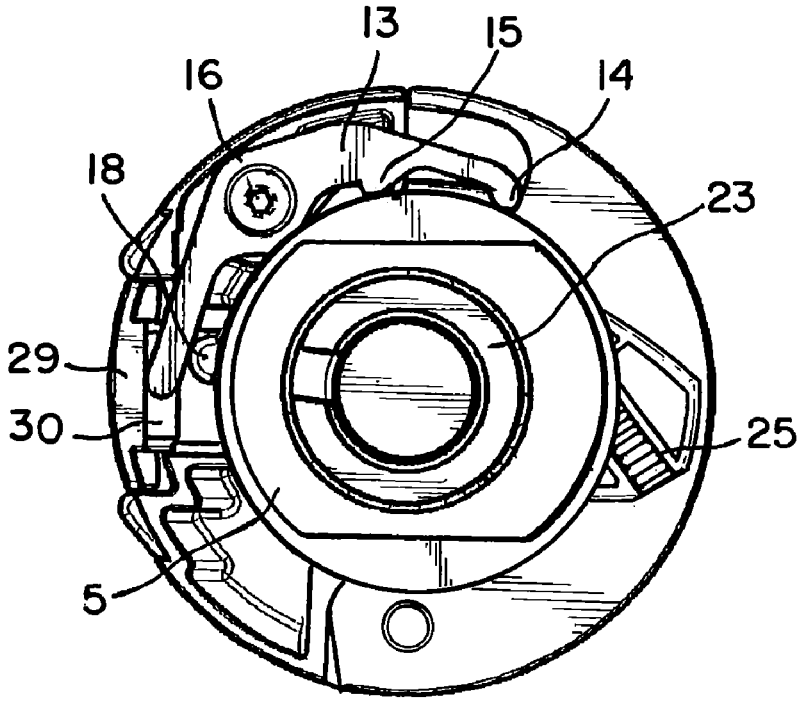
FIG. 8

FIG. 9
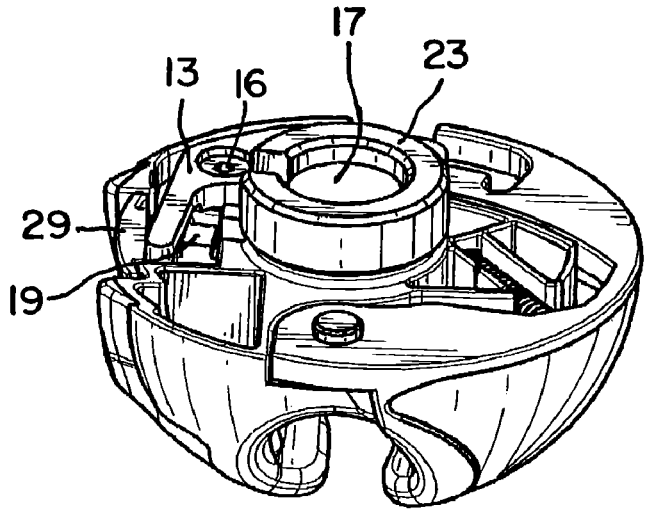
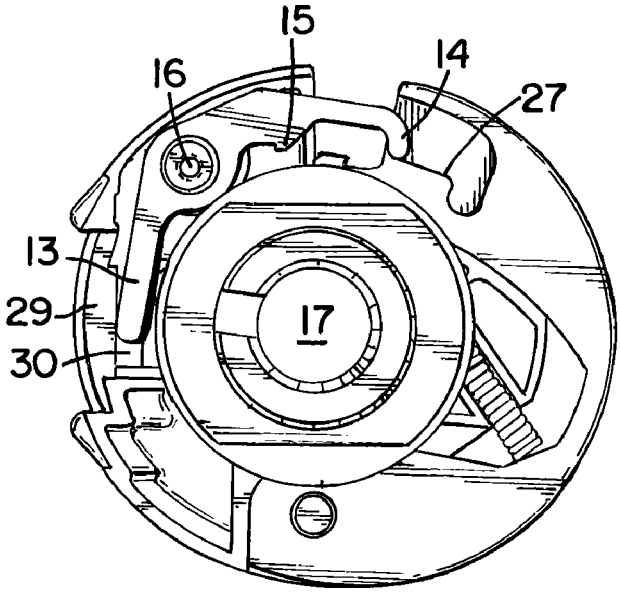
FIG. 10

SLIDE FOR LIFE-LINE

CROSS-REFERENCE TO RELATED APPLICATIONS

This Application claims priority to PCT application No. PCT/EP2006/061616, same title herewith, filed on Apr. 14, 2006, which claimed priority to French Patent Application 05/51043, filed on Apr. 22, 2005.

BACKGROUND

This invention relates to a slide for a life-line allowing displacement along a life-line.

Such a slide constitutes an intermediate element between a life-line generally formed by a cable retained at several points by support elements anchored in a fixing surface and a harnessing system worn by a person, such as a worker working on a site where there is a risk of accidental falling.

The slide is guided along the life-line and is connected, by cable or by rope in particular, to a harness or belt worn by the individual to be made secure.

The slide may also serve to move heavy objects along the life-line.

The document FR-A-2,813,800 discloses a slide for a life-line, comprising a moving jaw, delimiting with a fixed jaw a duct for its guidance on a cable.

According to this prior art, means are provided for controlling the opening of the jaw in order to raise the slide on the cable and for completely closing the jaw if a tractive force is exerted in a handle designed to be connected by a reinforced link.

In this device the handle serving to connect the slide to the person exhibits an articulation around an axis parallel with the axis of the cable, following a limited amplitude.

WO-A-02/092171 also discloses a slide that moves in translation along a life-line and has a body delimiting a guide passage for the life-line cable.

A handle is permanently and immovably mounted on the body.

The applicant has observed that such slide configurations suffered from numerous disadvantages, particularly from the practical point of view.

In fact a resistance to sliding along the life-line, even a risk of locking, is observed in practice, for example at the intermediate supports of the life-line cable due to the tractive force exerted by the operator on the handle, which tends to swivel the latter, and hence the entire slide, giving it an orientation which is not parallel with the life-line.

Therefore very localized surfaces on the edge of the guide duct come into contact with the life-line cable, producing high concentrations of stresses generating friction and presenting risks of locking.

It will also be observed that according to the state of the art, if the user wishes to maneuver on the other side of the life-line, he must necessarily disconnect the slide from the life-line, move on the other side of the life-line, and finally re-secure himself to the cable.

All these operations are not secure, which presents a substantial disadvantage.

SUMMARY

This invention provides a remedy to some or all of the disadvantages of the devices of prior art, and responds in particular to the needs to improve the connection between the handle and the slide section supporting the guide duct of the life-line cable.

Characteristically the invention exhibits a degree of freedom of rotation capable of preventing pivoting of the guide duct relative to the longitudinal axis of the life-line.

This avoids points of contact with high concentrations of stresses between certain isolated points on the edge of the guide and life-line cable.

The articulation between the handle and the body of the slide exhibits, in particular, a freedom of rotary movement along an axis that is perpendicular to the longitudinal axis of the guide duct, and different from the direction of traction of the connecting mechanism on the handle.

According to an advantageous embodiment, the freedom of movement thus produced has a limited movement around the axis perpendicular to the longitudinal axis of the guide duct to prevent the handle from taking a direction parallel with the longitudinal axis of the guide duct.

According to another advantageous embodiment, possibly after release of the limitation of movement of the handle, the latter may pivot at least 180° to enable the user to move on the other side of the life-line without having to detach himself from it.

More precisely, the user straddles the life-line cable, and the rotation of the handle relative to the slide body immediately adapts its position to this new configuration of use.

According to an advantageous variant, the guide duct comprises two jaws capable of being brought together or separated in order to close or open the guide duct, respectively, so that the coupling and uncoupling operations can be carried out on the life-line.

According to the invention safety means are provided to prevent any untimely opening of the guide duct.

In particular, an unlocking button is formed, a button which may possibly be combined with a release button, it being necessary to press both these buttons simultaneously or successively to open the guide duct.

Other purposes and advantages will become apparent in the course of the following description, which presents a preferred, but not exhaustive mode of the invention.

This invention relates to a slide for displacement along a life-line, comprising a body provided with a guide rove on a cable and a handle capable of interacting with an attached connecting mechanism, said handle being articulated relative to the body, characterized in that the articulation of the handle relative to the body comprises a freedom of rotary movement along an axis perpendicular to the longitudinal axis of the guide duct and different from the direction of traction of the connecting mechanism on the handle.

According to preferred but not exhaustive variants, this slide is designed so that:

- the axis intersects the longitudinal axis of the guide duct,
- the slide comprises means of angular limitation of the freedom of rotary movement,
- the slide comprises an angular sector of freedom of rotary movement of axis symmetrical about an axis perpendicular to the longitudinal axis of guide duct,
- the angular sector has an angle of 60°,
- the slide comprises a second angular sector symmetrical to the first angular sector,
- the slide comprises means of releasing the means of angular limitation,
- the means of release comprise a mobile release button capable of releasing a stop with two stop surfaces delimiting the angular sector or sectors, the handle comprises an eyelet for receiving an attached connecting mechanism, said eyelet being formed on a section of the handle that is not perpendicular to the axis of rotation, the guide duct is circumscribed by two jaws that move in relation to each other so that they are separated or brought together by a lockable connection, the jaws are mobile in a pivoted connection along an axis parallel with the axis of rotation of the handle, the slide comprises an unlocking button configured to actuate unlocking means, the unlocking means comprise a lever that is swiveled on one of the jaws between a free position and a hooking position in a hooking profile formed on the other jaw, the release button comprises a blocking position unlocking means and an unblocking position so that the unlocking of the pivot connection is made dependent on pressing the release button and the unlocking button, the release button is configured to release the stop in the zone of movement of the locking means, the stop is formed on a radial portion of a mobile mechanism driven by the release button in translation relative to the body, the slide comprises means for returning the release button and the mobile mechanism for active positioning of the stop.

BRIEF DESCRIPTION OF THE DRAWINGS

The appended drawings are given as an example and do not limit the invention. They represent only one embodiment of the invention and allow it to be easily understood.

FIG. 3 shows a perspective view of the slide of the invention.

FIG. 4 is a side view.

FIG. 5 shows in greater detail the lower face of the handle, and

FIG. 6 shows the slide in a bottom view when the guide duct is open.

FIG. 7 shows a perspective view of certain elements of the slide of the invention, and more particularly elements serving to lock and unlock the movement of the jaws.

FIG. 8 is a top view showing these elements.

Figure 1:
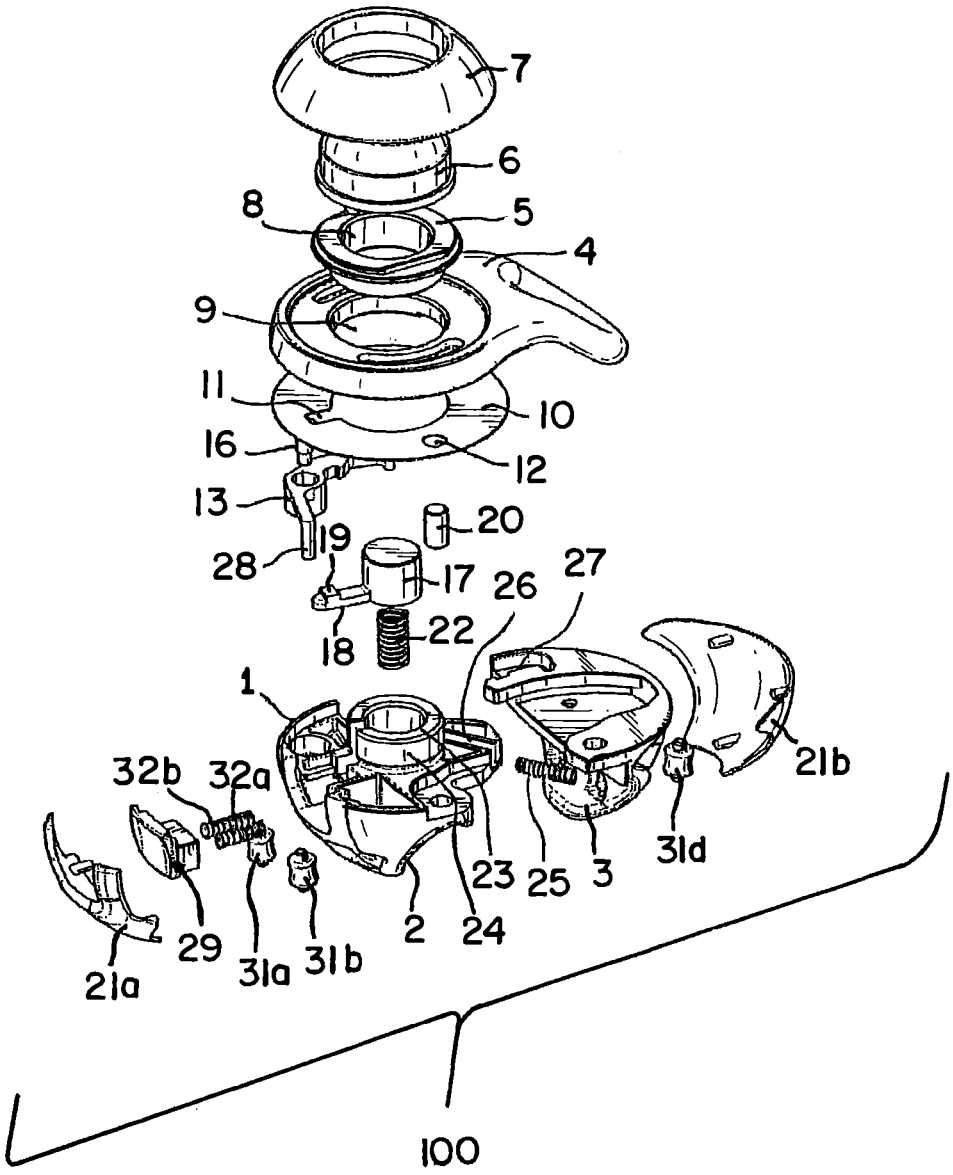
FIG. 1 shows a first exploded view of the elements constituting the slide of the invention.

In an equivalent manner,

FIGS. 9 and 10 show an open position of the unlocking means enabling the guide duct to be opened.

DETAILED DESCRIPTION

FIGS. 3 and 4 clearly show a slide 100 exhibiting a body 1 supporting a guide duct 38 capable of receiving, in its longitudinal direction, a life-line cable along which the slide performs a translatory movement.

Guide duct 38 advantageously has an essentially circular periphery with a diameter slightly exceeding the diameter of the cable so that it results in a good sliding motion and clears the intermediate loops without difficulty.

The slide also comprises a handle 4 provided with a zone of connection to the attached connecting mechanism, for example a rope with a snap hook enabling handle 4 of the slide to be connected to an external element such as a harness worn by the user.

Any attached connecting mechanism may be used.

In particular, handle 4 comprises a section provided with an eyelet 34 for interacting with this connecting mechanism.

As shown, in particular, in FIG. 4, handle 4 performs a rotary movement relative to body 1 about an axis 35, here shown in the vertical position, and advantageously located in the plane of symmetry of guide duct 38.

The axis of rotation 35 is perpendicular to the longitudinal axis of duct 38, and is different from the direction of traction of the connecting mechanism on handle 4, this direction generally lying in the plane of eyelet section 34.

As shown in FIG. 4, handle 4 advantageously exhibits a portion that is inclined relative to the plane perpendicular to axis of rotation 35, so that the point of contact between eyelet 34 and the connecting mechanism is lowered to a level equivalent to the axis of guide duct 38.

It will be observed that in the example shown in FIGS. 1 to 10, body 1 has an essentially spherical configuration with an opening pointing downwards to form guide duct 38.

In this context, axis 35 is preferably the axis of symmetry of the sphere.

According to a first embodiment, the freedom of rotary movement of axis 35 of handle 4 covers an angle of 360°, enabling it to assume any position relative to body 1.

This embodiment is particularly advantageous in that it enables the user to pass on the other side of the life-line without having to uncouple himself from it.

According to another embodiment, the movement of handle 4 is limited to an angular sector of 60°, for example, formed symmetrically around an axis perpendicular to the longitudinal axis of guide duct 38.

Such a movement is sufficient to prevent the traction of the connecting mechanism on handle 4 from giving rise to untimely pivoting of guide duct 38 relative to the life-line, whilst at the same time preventing handle 4 from assuming an orientation close to that of the longitudinal axis of duct 38.

In order to retain the possibility of using the slide 100 on the other side of the life-line without dismantling it, the invention is therefore advantageously provided with means of releasing the limitation of the angular movement of handle 4, (an angular limitation member described below).

In this manner the angular limitation may be bypassed by pressing a button 6, for example that shown in FIG. 3, and handle 4 may then be actuated by an angle of approx. 180° so that it can be positioned on the other side of guide duct 38.

A limitation of the movement of the handle is also advantageously formed on this side.

The possibility of limiting movement and releasing this limitation is described in greater detail below with reference to FIGS. 1 and 2.

In these figures, a release button 6, moving in translation under the action of the operator, gives rise to the displacement of a mobile mechanism 17 provided with a radial portion 18 with a stop 19 capable of interacting in an active position with a predetermined relief formed on the inner face of handle 4, as shown in FIG. 5.

In this figure two angular sectors 36*a*, 36*b*, delimited by stop surfaces 40*a*, 40*b*, 42*a* and 42*b*, limit the sector of movement of handle 4 relative to body 1 to values of approximately 60°.

It will readily be understood that when mobile mechanism 17 is in the active position, stop 19 is displaced in one of angular sectors 36*a*, 36*b*.

On the other hand, when the operator presses release button 6 stop 19 escapes from sectors 36*a*, 36*b*, which enables the handle to be rotated fully along axis 35.

The pivot of handle 4 is itself simply formed, for example, by inserting handle 4 between a guide 23 integral with body 1 and a nut 6, fitted by means of a threaded zone 8 onto a threaded zone 24 of guide 23.

The assembly of this handle is clearly shown in FIG. 1.

An insert ring 10 is advantageously provided between body 1 and handle 4 to limit the friction.

Figure 2:
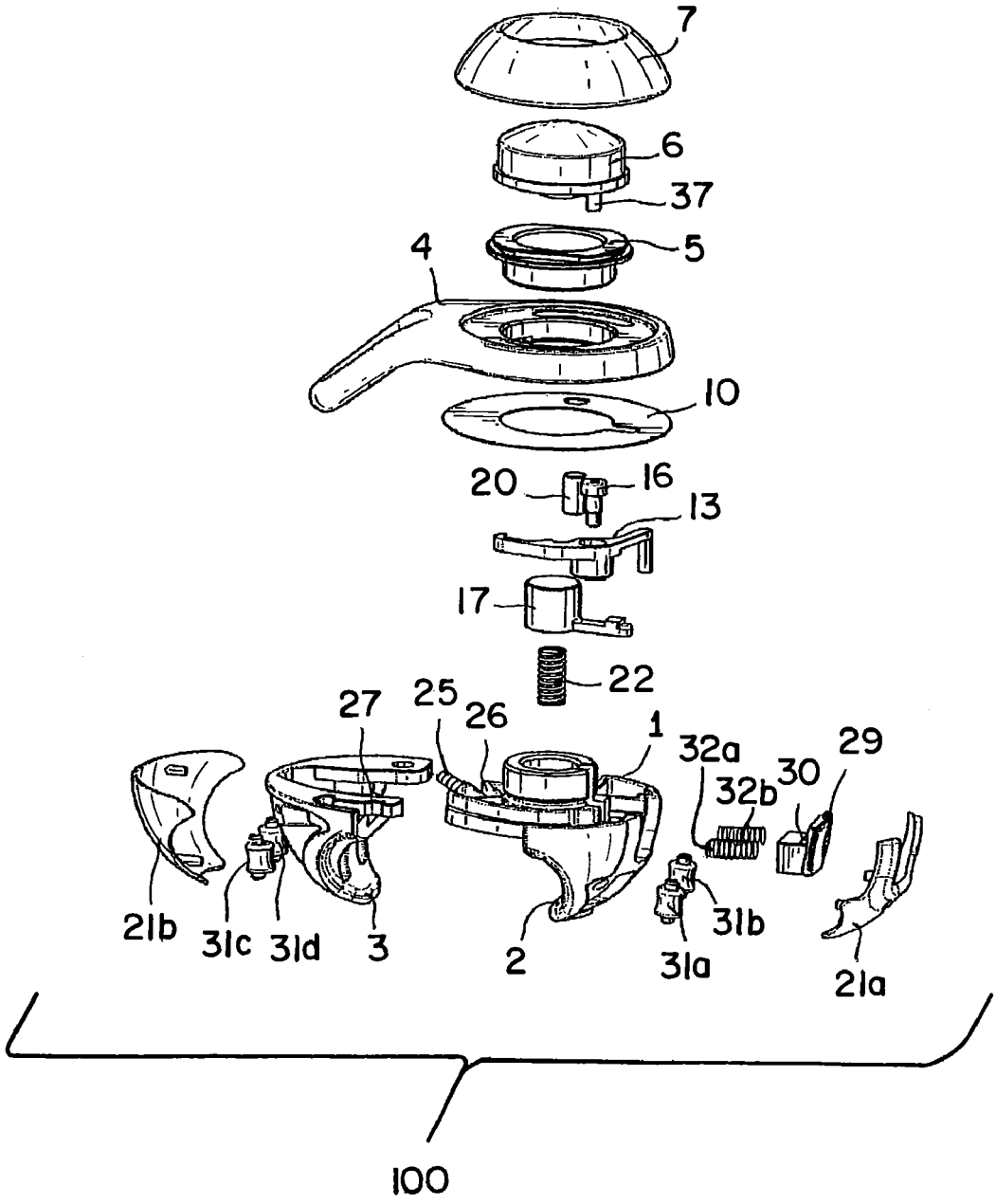
FIG. 2 shows a second exploded view from another viewpoint.

On the inner face of release button 6 a support lug (37), shown in FIG. 2, exerts pressure on mobile mechanism 17.

The latter is, moreover, mounted on elastic return means shown in the form of a spring 22 in FIGS. 1 and 2.

The inner volume of guide 23 serves to guide mobile mechanism 17 in a translatory movement.

In an upper section of the slide, a cover 7 enables the periphery of release button 6 to be covered so that it is protected and untimely action is prevented.

Cover 7 is mounted by clipping onto an edge formed on nut 5.

According to a first embodiment of the invention, guide duct 38 is delimited by fixed jaws 2, 3.

However, for ease of fitting and removing the slide 100 on the life-line, it is advantageous for jaws 2, 3 to perform a relative movement so that they can be brought together or separated.

Guide duct 38 may therefore be open or closed.

For this purpose, as shown in the different figures, a fixed jaw 2 is provided integral with the rest of body 1, whilst another mobile jaw 3 is articulated with an axial pivot 20 relative to body 1.

For ease of opening, a return element such as a spring 25, accommodated in housing 26 of body 1, provides an elastic return in the open position of mobile jaw 3.

In order to retain jaws 2, 3 safely in the closed position, locking means (locking mechanism) is provided.

According to the invention the opening of the locking means (locking mechanism) is conditioned by the action of the operator pressing an unlocking button 29 shown in the figures in the form of a lateral button.

It will be observed that buttons 6 and 29 shown have a translatory movement, but that a rotary action is not excluded from the scope of the invention.

As shown, button 29 exhibits an essentially vertical slot 30 capable of receiving a catch pin 28 integral with a lever 13 that pivots relative to body 1, along an axis 16.

At the end of lever 13 opposing catch pin 28, lever 13 comprises one or more teeth (primary tooth 14 and secondary tooth 15) capable of interacting with a hooking profile 27 designed to correspond to mobile jaw 3.

FIG. 8 shows in detail a case of interaction between lever 13 and hooking profile 27.

On the other hand, FIG. 10 shows that an uncoupled position of lever 13 and of hooking profile 27 ensuring opening of the guide duct.

It will be noted that it is advantageous for axis 20 of rotation of jaw 3 to be parallel with axis 35 of the freedom of movement of handle 4.

It will be readily understood that when unlocking button 29 is pressed by the user, this gives rise to rotation of lever 13, via slot 30 and catch pin 28, capable of disengaging teeth 14, 15 of hooking profile 27.

However, a default locked position is provided by means of elastic return means shown in the form of springs 32*a*, 32*b*.

It will be readily understood that any accidental or untimely opening of guide duct 38 is detrimental to safety.

In order to improve the safety of the assembly, the unlocking may be made dependent on another operation, particularly additional pressing of release button 6.

It will be noted, however, that a third button could be formed in order to condition the operation of the unlocking means.

The unlocking may therefore be made dependent on a predefined position of handle 4, for example in released operation and parallel with the axis of guide duct 38.

However, in the case illustrated, pressing release button 6 is required to set lever 13 in motion in combination with unlocking button 29.

More precisely, pressing release button 6 gives rise to a lowering of mobile mechanism 17, whose radial portion 18, which up till that point rested on one side of lever 13, releases it, enabling lever 13 to rotate when the user presses unlocking button 29.

FIGS. 7 and 8 clearly show the application of the end of radial portion 18 of mobile mechanism 17 on lever 13, whilst in the case of FIGS. 9 and 10, the end of radial portion 18 has passed underneath lever 13. The latter was then able to perform its rotation until it reached stop 19 limiting the angular movement of lever 13.

Release button 6 therefore has two functions because it contributes both to the release of the limitation of angular movement of handle 4 and to the actuation of the unlocking means.

It will be noted that the locking and unlocking mechanism previously described may be used in a slide 100 of the conventional type that does not provide for the rotary movement of handle 4 relative to the body along previously defined axis 35.

In the different figures, a plurality of rollers 31*a, b, c, d* is present and is inserted in housings configured to position rollers 31*a, b, c, d* on the walls of guide duct 38 to facilitate the displacement.

In particular, two rollers 31*a* and *b* are mounted on fixed jaw 2, and two other rollers 31*c* and *d* are mounted on mobile jaw 3.

Finally it will be noted that guide 23 exhibits a vertical slot that enables mobile mechanism 17 to perform a translatory movement.

Similarly, FIGS. 1 and 2 show that insert ring 10 is provided with a hole 12 for the passage of axis 20 and an indentation 11 for passage of radial portion 18 of mobile mechanism 17.

It will be readily understood that the slide thus described exhibits a high degree of compactness whilst ensuring optimum safety.

Moreover, the movement between handle 4 and the section supporting guide duct 38 enables the slide 100 to be displaced satisfactory along the life-line without a friction point.

REFERENCES

1. Body
2. Fixed jaw
3. Mobile jaw
4. Handle
5. Nut
6. Release button
7. Cover
8. Threaded zone
9. Opening
10. Insert ring
11. Indentation
12. Hole
13. Lever
14. Primary tooth
15. Secondary tooth

16. Axis
17. Mobile mechanism
18. Radial portion
19. Stop
20. Pivot axis
21*a*, 21*b*. Sides
22. Spring
23. Guide
24. Threaded zone
25. Spring
26. Housing
27. Hooking profile
28. Catch pin
29. Unlocking button
30. Slot
31*a*, 31*b*, 31*c*, 31*d*. Rollers
32*a*, 32*b*. Spring
33. Direction of traction
34. Eyelet
35. Axis of rotation
36*a*, 36*b*. Angular sector
37. Support lug
38. Guide duct

The invention claimed is:

1. A slide for displacement along a life-line, comprising:

a body having a guide duct configured and arranged to receive a cable, wherein the guide duct includes two jaws that are configured and arranged to move in relation to each other;

a handle including an eyelet configured and arranged to attach a connection member thereto, the handle being rotatably coupled to the body, the handle having a rotary movement about an axis of rotation that is perpendicular to a longitudal axis of the guide duct of the body;

an angular limitation member, the angular limitation member having at least one recessed angular sector delimited by spaced stop surfaces in the handle and a stop coupled to the body, the stop configured and arranged to be selectively received within the at least one recessed angular sector to selectively set an angular sector of free rotation of the handle in relation to the body that is greater than 0° via movement of the stop in the recessed angular sector between the spaced stop surfaces, the angular limitation member including a release button configured and arranged to remove the stop from the at least one recessed angular sector when the release button is pressed;

a locking mechanism configured and arranged to selectively lock the jaws in a closed position, the locking mechanism including an unlock button, wherein the locking mechanism is configured and arranged to unlock the jaws only when the unlock button and the release button that is in mechanical communication with the unlock button are simultaneously pressed; and an elastic return member configured and arranged to bias the locking mechanism in a default lock position.

2. The slide according to claim 1, wherein the axis of rotation intersects the longitudinal axis of the guide duct.

3. The slide according to claim 1, wherein the angular sector of rotation formed by the at least one recessed angular sector and the stop has a freedom of rotary movement about the axis of rotation which is within a plane of symmetry of the longitudinal axis of the guide duct.

4. The slide according to claim 1, wherein the angular sector of rotation formed by the at least one recessed angular sector and the stop has an angle of 60°.

5. The slide according to claim 1, wherein the at least one recessed angular sector in the handle of the angular limitation member includes a first and a second recessed angular sector, the first recessed angular sector being symmetrical in the handle in relation to the second recessed angular sector.

6. The slide according to claim 1, further comprising:

a releasing member configured and arranged to selectively release the stop from the at least one recessed angular sector.

7. The slide according to claim 6, wherein the releasing member further comprises:

a mobile release button configured and arranged to release the stop from stop surfaces defining the at least one angular sector of the angular limitation member.

8. The slide according to claim 7, wherein the stop is formed on a radial portion of a mobile mechanism driven by the release button in translatory movement relative to the body.

9. The slide according to claim 8, further comprising:

a return for biasing the release button and the mobile mechanism for active positioning of the stop.

10. The slide according to claim 1, further comprising:

the eyelet being formed on a section of the handle that is not perpendicular to the axis of rotation.

11. The slide according to claim 1, wherein at least one of the jaws is pivotally coupled to the body about an axial pivot that has a pivot axis that is parallel with the axis of rotation of the handle.

12. The slide according to claim 1, wherein the elastic return member is at least one spring.

13. The slide according to claim 12, wherein the locking mechanism further comprises;

a lever pivoted on one of the jaws between a free position and a hooking position in a hooking profile formed on the other one of the jaws.

* * * * *